United States Patent [19]

Crandall et al.

[11] 4,321,592

[45] Mar. 23, 1982

[54] MULTIPLE SENSOR INTRUSION DETECTION SYSTEM

[75] Inventors: Richard E. Crandall, Portland, Oreg.; Sheldon P. Apsell, Nahant; Aaron A. Galvin, Lexington, both of Mass.

[73] Assignee: American District Telegraph Company, New York, N.Y.

[21] Appl. No.: 910,534

[22] Filed: May 30, 1978

[51] Int. Cl.[3] ..... G08B 25/00

[52] U.S. Cl. ..... 340/541; 340/521; 340/524; 340/531

[58] Field of Search ..... 340/505, 506, 504, 518, 340/521, 524, 531, 538, 541, 536

[56] References Cited

U.S. PATENT DOCUMENTS

| | | | |
|---|---|---|---|
| 3,713,142 | 1/1973 | Getchell | 340/505 |
| 3,716,834 | 2/1973 | Adams | 340/524 X |
| 3,735,396 | 5/1973 | Getchell | 340/524 X |
| 3,927,404 | 12/1975 | Cooper | 340/518 |
| 4,044,351 | 8/1977 | Everson | 340/505 |
| 4,093,946 | 6/1978 | Fowler | 340/505 |
| 4,101,875 | 7/1978 | Humphries | 340/504 |
| 4,117,479 | 9/1978 | Galvin et al. | 340/506 X |

*Primary Examiner*—John W. Caldwell, Sr.
*Assistant Examiner*—Joseph E. Nowicki
*Attorney, Agent, or Firm*—Weingarten, Schurgin & Gagnebin

[57] ABSTRACT

A multiple zone intrusion detection system in which a plurality of intrusion sensors can be readily converted into the system without system modification, and in which mode control signals from a central control unit and alarm signals from the sensors are both conveyed on a single conductor of the system cable. Each sensor has an associated interface module which permits coupling of different types of sensors to the system and sharing of a single conductor for mode control signals and alarm signals.

9 Claims, 7 Drawing Figures

MULTIPLE SENSOR INTRUSION DETECTION SYSTEM

FIELD OF THE INVENTION

This invention relates to intrusion detection systems and more particularly to a system employing a plurality of sensors which can be of different types and which are coupled by a common cable to a central control unit.

BACKGROUND OF THE INVENTION

Intrusion detection systems are known for protecting a plurality of zones within a facility. Such systems usually include a central control unit connected by means of a cable to one or more sensors located at each protected zone. Upon an alarm condition in a zone, an alarm signal is transmitted back to the control unit for actuation of an alarm and desirably to denote which zone in which an alarm has occurred. It is often desirable to provide an intrusion detection system in which different types of sensors are employed in respective zones. For example, it may be useful to employ an ultrasonic sensor in one zone and an active or passive infrared sensor in another zone to suit specific performance requirements. It would be advantageous to accommodate sensors of different types in a single system without need for alteration of the system itself to permit connection of different types of sensors thereto.

SUMMARY OF THE INVENTION

In brief, the present invention provides a multiple zone intrusion detection system in which a plurality of intrusion sensors can be readily connected into the system without modification of the system, and in which mode control signals from a central control unit and alarm signals from the sensors are both conveyed on a single conductor of the system cable. The novel system comprises a single control unit coupled by an interconnecting cable to a plurality of sensors, which can be of different types, and an interface module for each sensor to permit coupling of the sensor to the system and sharing of a single conductor of the system cable for mode control signals and alarm signals.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
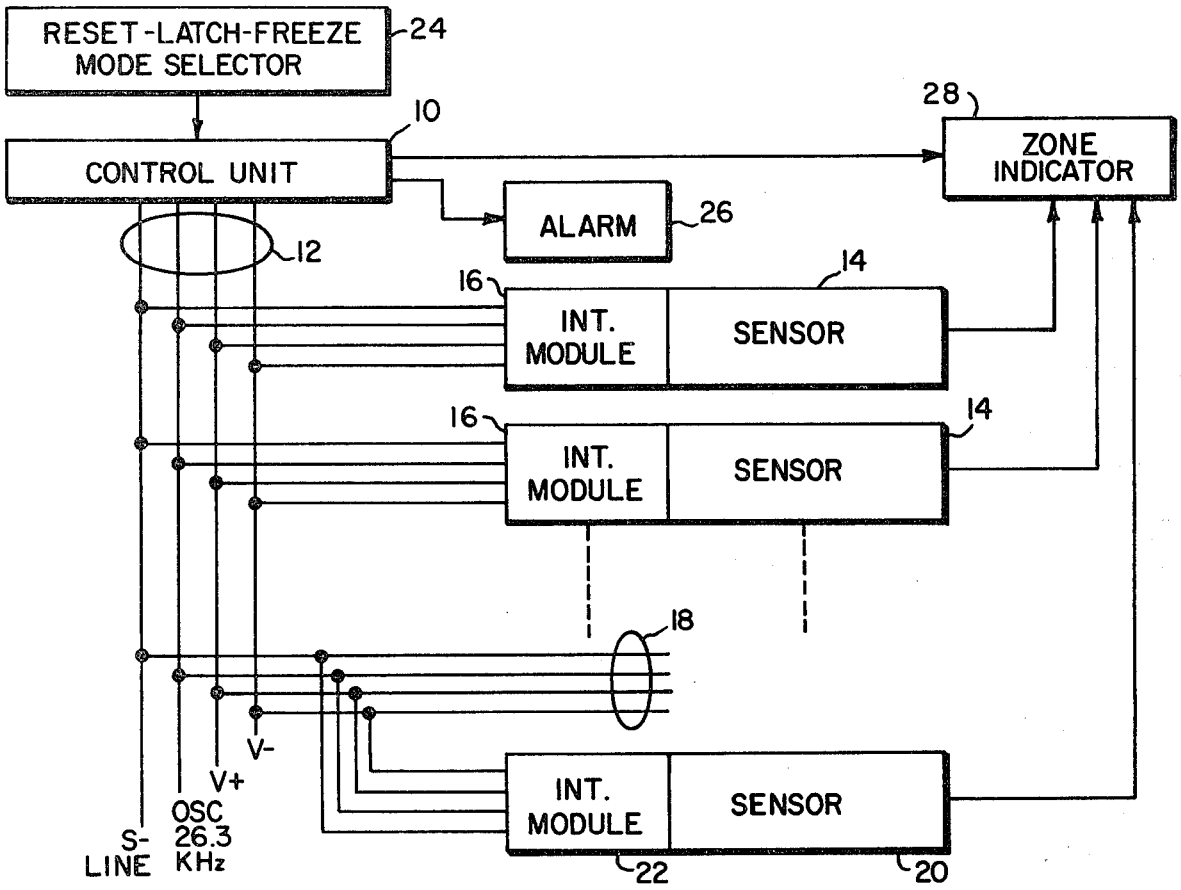
FIG. 1 is a block diagram of an intrusion detection system embodying the invention.

An intrusion detection system embodying the invention is shown in FIG. 1 and includes a control unit 10 having a multi-conductor cable 12 extending along a path within a facility being protected. A plurality of sensors 14 are coupled to respective interface modules 16 which in turn are coupled to cable 12. Each sensor or group of sensors is disposed at respective zones of the facility. One or more branch cables 18 can also be connected to cable 12 and to which are connected one or more sensors 20 and associated interface modules 22. A mode selector 24 is connected to control unit 10 and is operative to provide mode control signals thereto for communication with the remote sensors 14 and 20 for control of the sensor indicators, as will be described. The control unit is also coupled to an alarm 26 for providing an output indication of an alarm condition and which indication can be provided either locally at the location of the control unit or remotely as at a central station.

A zone indicator 28 is also coupled to control unit 10 and sensors 14 and 20 to provide annunciation of particular zones in which an alarm condition occurs. The cable 12 in the illustrated embodiment is a four conductor (quad) unshielded cable. Two conductors of the cable are employed for DC power to the remote sensors and one of which conductors is typically grounded. A third conductor carries an oscillator signal, typically 26.3 kHz, for those sensors 14 and 20 requiring the same, such as ultrasonic or electromagnetic Doppler sensors. The fourth cable conductor, labelled S-line, is employed to convey alarm signals from the sensors to the control unit upon alarm detection, and to convey control signals from the control unit to the sensors for control of the operating mode of the sensor indicators. For central indication of zone status, indicator 28 is wired to each of the system sensors.

The multiple operating modes provided by mode selector 24 are described in copending application Ser. No. 677,661, filed Apr. 16, 1976, now U.S. Pat. No. 4,117,479 and assigned to the assignee of this invention. By such multimode operation, indications can be provided at the sensor indicators of present and past occurrence of alarm signals from the plurality of sensors. The ability of the system to detect an alarm and actuate alarm 26 is not affected by the selected mode. The different modes allow determination of which sensor produced an alarm signal, investigation of the protected area after occurrence of an alarm signal without disturbing the alarm determination, and resetting of the system. The modes are designated reset, latch and freeze. In the reset mode, which is the normal alarm mode, each of the indicators is reset and will indicate the presence of an alarm signal as it occurs. After cessation of the alarm signal the indicator will automatically reset. Thus, the reset mode is the normal mode in which an alarm indication is provided only during the presence of an alarm signal. In the latch mode, any sensor which detects an intrusion and produces an alarm signal also triggers an associated indicator which remains on or "latched" even after the alarm signal has ceased. In the freeze mode, the outputs of all of the indicators can be maintained in their state at the time this freeze mode is initiated such that the then state of the zone sensors can be investigated. This mode is useful for example to permit investigation of premises without having the investigator's movement in the protected areas cause change in the state of the indicators.

Figure 2:
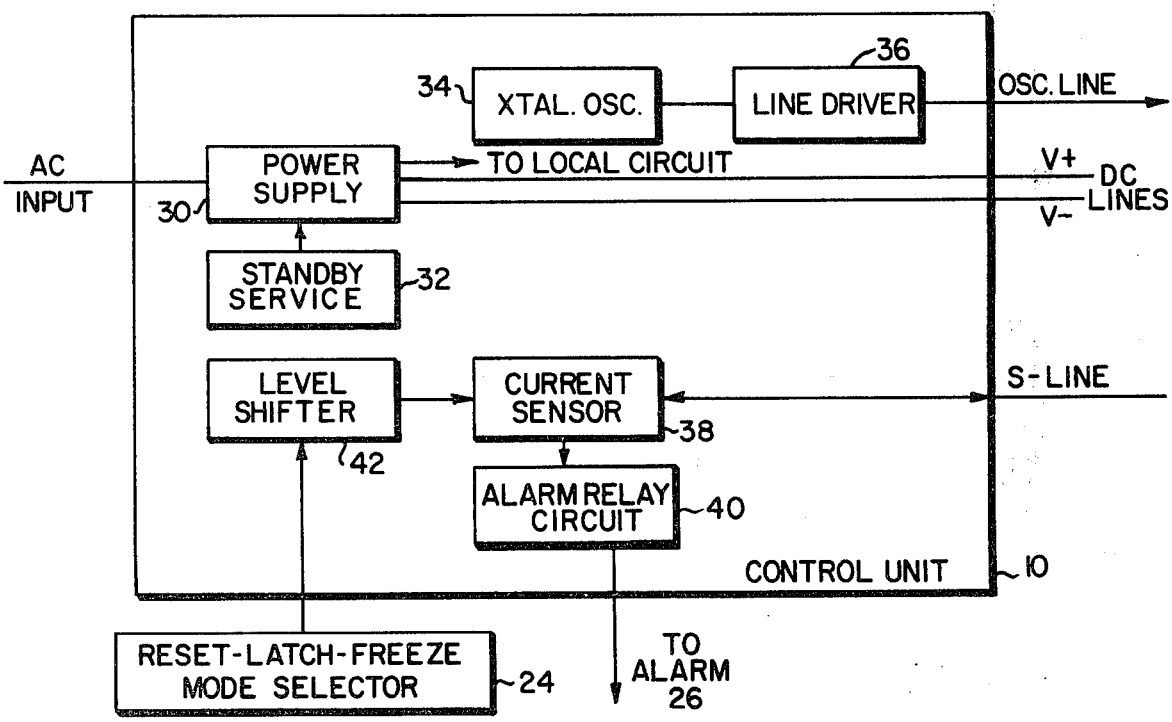
FIG. 2 is a block diagram of the control unit of a type employed in the invention.

The control unit 10 is shown in typical implementation in FIG. 2. A power supply 30 is energized from an AC source, and can include a stand-by source 32 such as a battery, to provide power for the control unit circuitry as well as DC power over the respective power conductors of cable 12 to the sensors 14 and 20. A crystal oscillator 34 drives a line driver 36 which is coupled to the oscillator line of cable 12 for providing an oscillator signal to the sensors requiring the same. The S-line of cable 12 is coupled to a current sensor 38 which provides output signals to an alarm relay circit 40 which is operative to actuate local or remote alarms. A reset-latch-freeze selector 24 provides mode control signals to a level shifter 42 which provides corresponding control signals via current sensor 38 to the S-line for transmission to the interface modules 16 and 22 of the associated sensors.

The sensors 14 and 20 can be of many different forms to provide detection, in an active or a passive manner, of intruder presence in a protected zone. Typically, the sensors are ultrasonic transceivers which include transmitting and receiving transducers and associated circuitry for intrusion detection. Such a transceiver is described for example in U.S. Pat. No. 3,665,443 assigned to the assignee of the invention. The sensors can also be active or passive infrared intrusion sensors, or alarm switches.

Figure 3:
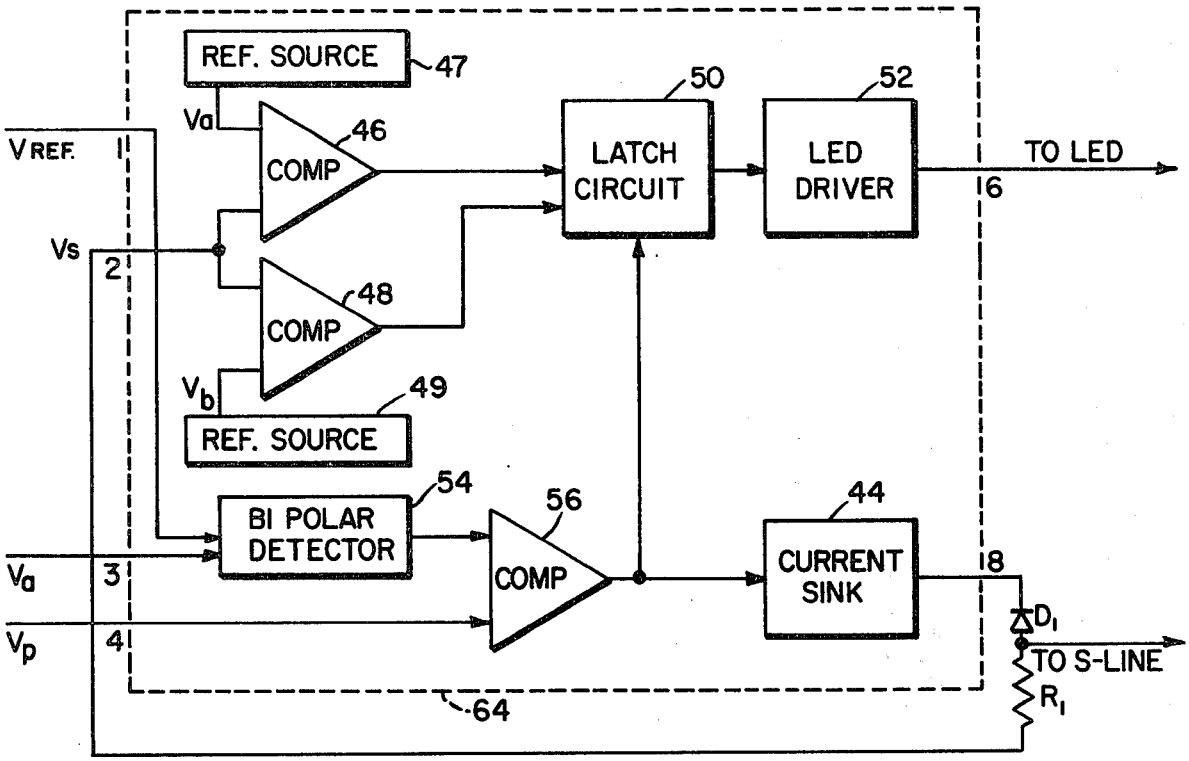
FIG. 3 is a block diagram of the interface module according to the invention.

The interface modules 16 and 22 are of identical construction and the circuitry thereof is shown in FIG. 3. The module is employed to couple a respective sensor 14 and 20 to the cable for communication with the central control circuit 10. The circuitry 64 of the interface module is preferably implemented in integrated circuit form on a single chip package in any convenient form, typically as an 8 pin dual-in-line (dip) integrated circit package. The integrated circuit together with associated discrete components comprises the interface module. The circuitry 64 has four input terminals respectively labelled $V_{ref}$, $V_s$, $V_A$, $V_p$. The circuitry 64 has two outputs, one for coupling to an LED or other output indicator and the other for coupling to the S-line for communication of alarm signals to the control unit 10. The input and output terminals or pins of the circuitry 64 are numbered consistent with subsequent drawing figures to be described. Although now shown in FIG. 3, the circuitry 64 also includes pins 5 and 7 which provide power connection. The S-line of the cable is coupled to the junction of a diode D1 and a resistor R1 connected as shown between the output of a current sink 44 (pin 8) and one input of a pair of comparators 46 and 48 (pin 2). The diode-resistor network serves as a decoupling network for incoming mode control signals and outgoing alarm signals.

A reference voltage $V_a$ is applied to the second input of comparator 46, while a reference voltage $V_b$ is applied to the second input of comparator 48. These reference voltages are internally provided by respective sources 47 and 49. The outputs of comparators 46 and 48 are coupled to a latch circuit 50, the output of which is applied to an LED driver 52 which provides an output signal for energizing one or more LED or other output indicators. Input signals ($V_A$) from an alarm sensor are applied to a bipolar detector 54, the output of which is applied to one input of a comparator 56, the output of which is coupled to current sink 44 and to latch circuit 50. A reference voltage $V_p$ is provided to the second input of comparator 56. A reference voltage $V_{ref}$ is also applied to detector 54.

The interface module permits the connection of different types of sensors to the alarm system and the sharing of the S-line for both alarm and control signals. The alarm signals can be derived from switch closures or openings or other interruptions in an alarm connection, or from signals provided by ultrasonic, electromagnetic or infrared motion sensors. The bipolar detector 54 provides, in response to a differential input, a unipolar signal level to comparator 56. The alarm threshold is determined by the level of the reference voltage $V_p$ applied as a reference input to comparator 56. If an alarm signal applied to comparator 56 exceeds the threshold level, a comparator output signal is provided to current sink 44 to provide an alarm signal to the S-line for transmission to the control unit 10 for actuation of alarm 26. Mode control signals $V_s$ conveyed on the S-line to the interface module are applied to comparators 46 and 48. These control signals provided by mode selector 24 are of one of three discrete voltage levels.

In the latch mode, the control voltage is of a magnitude, typically 6.3 volts, such that neither comparator 46 nor 48 is triggered. The latch circuit 50 is operative in response to the signal received from comparator 56 to latch to provide a signal to LED driver 52 for driving an LED indicator which will, in this latch mode, remain on independent of the input state of the associated sensor. In the reset mode, the control voltage $V_s$, typically 9.9 volts, is such that comparator 46 is triggered to provide a signal to latch circuit 50 which disables the latch and permits the associated LED to indicate the then actual state of the sensor. In the presence of an alarm condition, the comparator 56 provides a signal to latch circuit 50 which will, via driver 52, cause illumination of the LED. The LED will remain on only so long as an alarm signal is present as determined by the signal from comparator 56. In the freeze mode, the corresponding control voltage $V_s$, typically 3.5 volts, causes triggering of comparator 48 which effectively inhibits the input from comparator 46 to latch circuit 50 such that the associated LED remains in its previous state as driven by driver 52. Any new alarm signal from comparator 56 does not affect the state of the LED in this freeze mode. It is important to note that the alarm 26 at the control location, that is the system alar, is still operative in any of the modes so that an alarm detection will cause a system alarm even though the local indicators may or may not respond depending upon the particular setting of the mode control.

Figure 4:
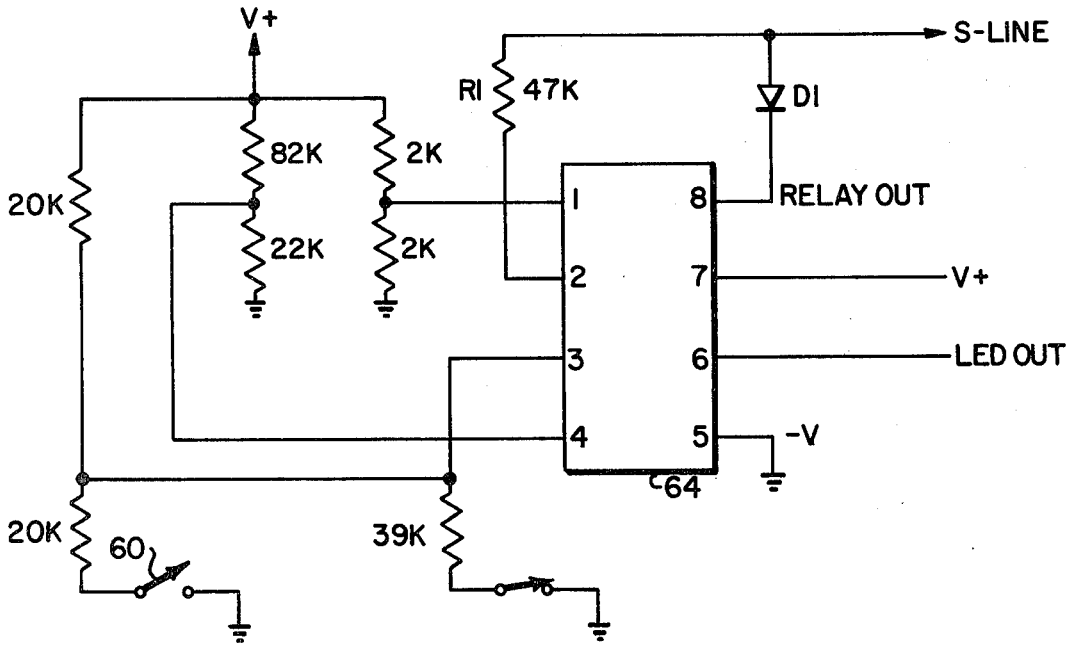
FIG. 4 is a schematic diagram of the interface module of FIG. 3 illustrating its use with alarm switches.

The interface module employed with alarm switches is shown in FIG. 4. The module includes integrated circuit 64 and associated discrete components having typical values shown. A normally open switch 60 and a normally closed switch 62 are coupled via respective resistors to pin 3 of integrated circuit 64. Actuation of these switches causes an input signal $V_A$ to circuit 64 which is detected to denote an alarm condition. A reference voltage $V_{ref}$ is applied to pin 1 via a resistive divider powered by source V+. A reference voltage $V_p$ is also provided by an associated voltage divider network to pin 4. Pins 2 and 8 are coupled to the S-line via the series connected resistor-diode network. As described above, alarm output signals are provided by the interface module to the S-line for transmission to the control unit 10 for actuation of alarm 26. Mode control signals transmitted by control unit 10 on the S-line are received by the interface module for government of the operating mode of the sensor indicators. Pins 7 and 5 of integrated circuit 64 are connected to the V+ and V− power lines of the system cable which provide energization of the module. Pin 6 provides an output for an LED or other appropriate indicator at the sensor location and/or at zone indicator 28 at the location of the central control unit.

Figure 5:
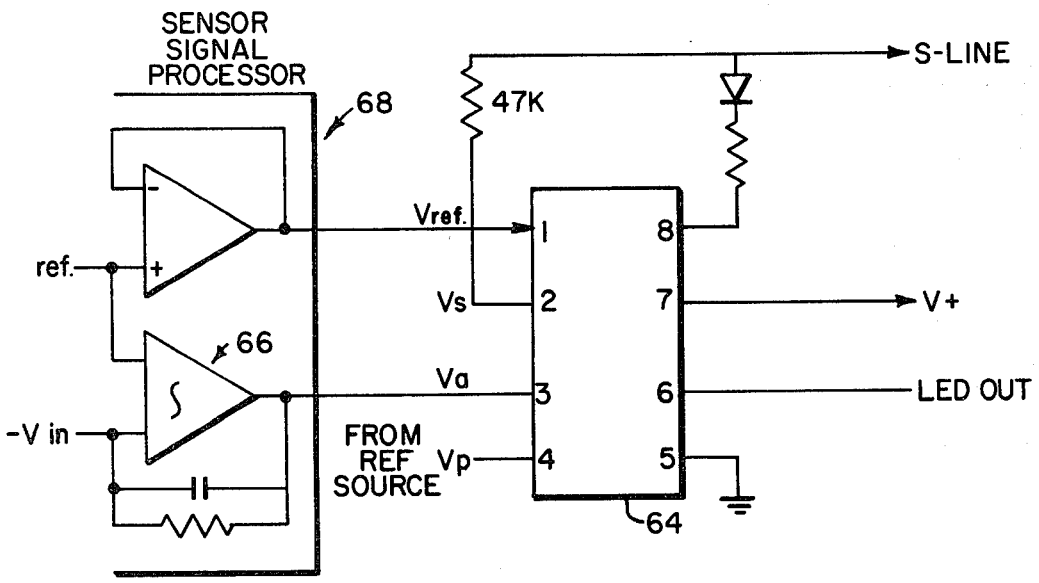
FIG. 5 is a schematic diagram illustrating connection of the interface module to a sensor.

The use of the interface module with a sensor of the ultrasonic type is illustrated in FIG. 5. The sensor signal processing circuitry includes an integrator 66 and a reference source 68. The integrator 66 provides an input signal to pin 3 of the module, while a reference signal from source 68 is provided to pin 1 of the module. The reference input to pin 4 is provided from a voltage divider or other reference source which is usually part of the module itself. An output signal from integrator 66 which exceeds the reference level provided by source 68 is processed by the module to provide an output indication of an alarm condition.

Figure 6:
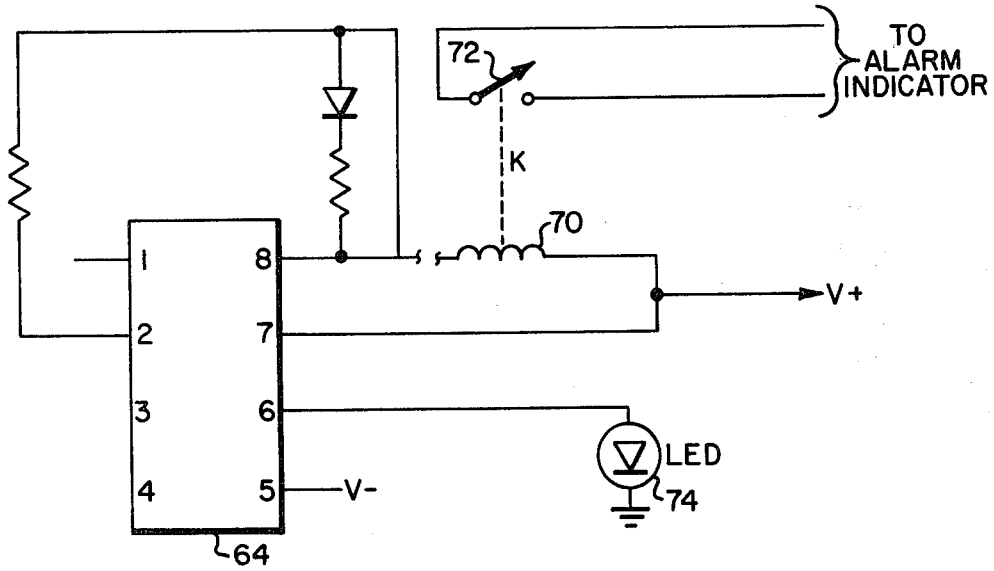
FIG. 6 is a schematic diagram illustrating connection of the interface module to an output indicator and an alarm relay.

The output connections of the interface module are shown in FIG. 6. Pins 2 and 8 are coupled via the diode-resistor network to the S-line of the system cable which is connected to the control unit 10 and which includes an alarm relay 70 and associated relay contacts 72 which actuate a bell, light or other alarm reporting device. Pin 6 is connected to an LED 74 which can be part of zone indicator 28, and which can also be a local indicator at the sensor location. Upon an alarm condition detected by one or more of the system sensors, an alarm current is provided, by way of the interface module, on the S-line to cause operation of the alarm relay 70 and closure of the relay contacts 72 for actuation of the alarm. The LED can also be driven via an RC network to provide a blinking indication.

Figure 7:
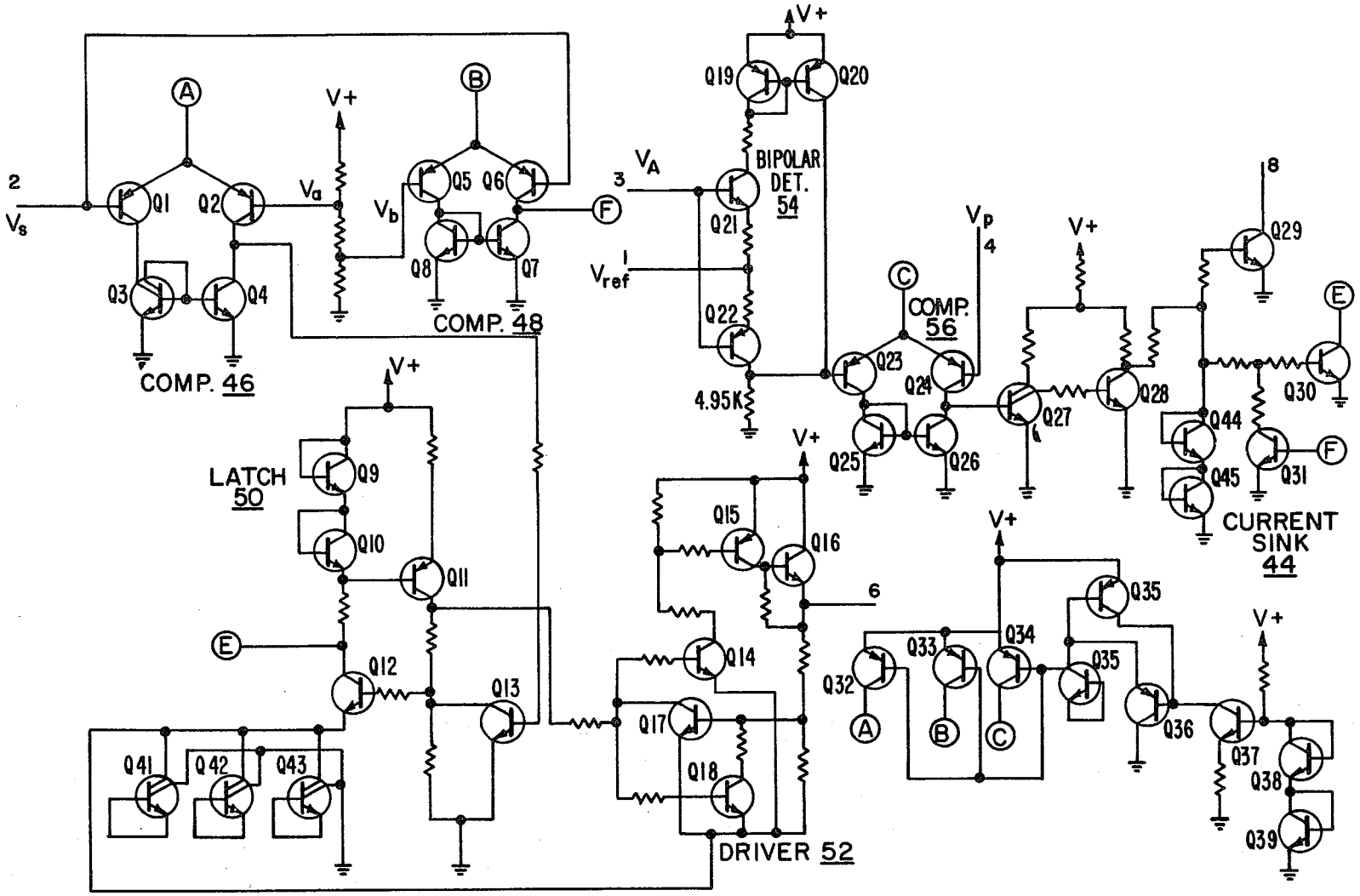
FIG. 7 is a schematic diagram of the interface module of FIG. 3.

A schematic diagram of the circuit 64 is shown in FIG. 7. Comparator 46 is composed of transistors Q1–Q4, and comparator 48 is composed of transistors Q5–Q8. The emitter currents of Q1, Q2 and Q5, Q6 are provided by respective current sources Q32 and Q33. The comparator outputs are at the collectors of Q4 and Q8. Part of the collector currents of Q2 and Q6 are used to bias the bases of Q13 and Q31. The mode control signals $V_s$ in this implementation can be at voltages of 0.5 V+ for the latch mode, above 0.63 V+ for the reset mode, and below 0.37 V+ for the freeze mode. When input signal $V_s$ is 0.5 V+, collector current in Q1 and Q5, Q2 and Q6 are off, and there is no bias available to Q13 and Q31. When $V_s$ is above 0.63 V+, Q1 is off and Q2 is on, providing bias current to Q13. When $V_s$ is below 0.37 V+, Q6 is on and provides bias current to Q31.

The bipolar detector is composed of Q21 and Q22. The comparator 56 is formed by Q23–Q26. When the voltage $V_A$ is above or below $V_{ref}$ by at least $V_{be}$, either Q21 or Q22 will be turned on depending on the relative polarity of the input voltages. The voltage developed across the 4.95 K resistor from the collector of Q22, is a function of the collector currents of Q21 and Q22 and the base current of Q23. When Q21 is on, the current mirror of Q19 and Q20 provides current to the 4.95 K resistor. Normally Q21 and Q22 are not on and have no contribution to the 4.95 K resistor current; the resistor current is then a function of the Q23 base current. The voltage across this resistor is an input to comparator 56. The other input is the voltage $V_p$.

With no differential between $V_A$ and $V_{ref}$, the base of Q23 is at a lower potential than the base of Q24; thus, Q23 in on and Q24 is off. With Q24 off, Q27 is also off, enabling Q28 to turn on. With Q28 on, there is insufficient current to bias on Q29 and Q30 and these transistors remain off. With a sufficient differential between $V_A$ and $V_{ref}$, the base voltage of Q23 will rise above the Q24 base level, turning on Q24. Q27 is then biased on, turning off Q28, and allowing the Q28 collector to rise to sufficient voltage, changed by Q44 and Q45, to turn on Q29 and Q30.

The transistor Q31 is controlled by the output of comparator 48. When Q6 is on, Q31 is on, thereby preventing Q30 from being turned on.

The latch circuit 50 is composed of Q9–Q13 and Q41–Q43. Q9 and Q10 are connected as diodes to clamp Q11 to set its emitter current at 0.7 ma. Q12 provides positive feedback to insure that Q11 remains in conduction. Q13 controls the state of Q12 and thus controls the operation of the latch. Q41–Q43 provide a low impedance return to ground.

Normally the bias string for Q11, formed by Q9, Q10 and the 7.2 K resistor, has no return to ground, which prevents Q11 from turning on. The ground return is provided by Q20 when it is conducting. When Q30 is on, current flows in the bias string to turn on Q11. Base drive for Q12 is derived from the Q11 emitter current, as is the bias current for Q14 and Q17. Unless Q13 is on, Q11 will be free to latch on via the positive feedback action of Q12. Once Q11 has latched, it will remain on independent of the state of Q31. When Q13 is on, Q11 will not latch on.

The LED driver 52 is composed of Q14–Q18. Q14, Q17 and Q18 form a blinker circuit, the duty cycle of which is determined by an external RC network between output pin 6 and the LED indicator. Q15 and Q16 form the driver circuit. The output of Q11 in the latch circuit turns on Q14 and Q18. Q14 provides a return for the bias string of Q15. Q18 acts as a pull down for the Q16 emitter circuit.

The emitter current of Q16 flows through the series combination of the 4.95 K and 900 ohm resistors and Q18. When the forward drop across the 900 ohm resistor and the $V_{ce}$ of the Q13 is sufficient, Q17 is biased on, pulling the bias string for Q14 and Q18 low, turning off Q14 and Q18 as well as Q15 and Q16. Q17 then loses its base drive which is a function of the state of Q16. This cycle is repeatable at a rate determined by the external RC network. if a non-blinking output is desired, pin 6 is clamped to ground by way of the LED indicator and limiting resistor.

The current sources for the three comparators are provided by Q31–Q34. Q35 serves as the control element and is coupled to Q32–Q34 via Q40. Q36 provides a return for the base currents of Q32–Q35. Q37 sets the current level. Q38 and Q39 provide a clamp for Q37.

The invention is not to be limited except as indicated in the appended claims.

What is claimed is:

1. An intrusion detection system comprising:

a control unit coupled to a multi-conductor cable extending along a predetermined path in a facility to be protected;

a mode selector coupled to said control unit and providing mode control signals which are at respective signal levels corresponding to selected display modes of sensor indicators for control of the operating display mode of the sensor indicators;

one or more intrusion sensors associated with the sensor indicators and connected to said cable and operative to provide an alarm signal upon intrusion detection;

alarm means coupled to said control unit and operative to denote an alarm condition detected by one or more of said intrusion sensors;

for each of said sensors, an interface circuit coupling its sensor to said cable and operative in response to the mode control signals received on one line of said cable from said control unit to determine the display mode of the sensor indicator, and operative in response to alarm signals from said sensor to convey an alarm signal on the same line of said cable to said control unit for actuation of said alarm means irrespective of the selected display mode of the sensor indicator specified by the mode control signals.

2. The system of claim 1 including a zone indicator coupled to said sensors and operative to provide an indication of the zone in which an intrusion detection has occurred.

3. The system of claim 1 wherein said intrusion sensors are of different types.

4. The system of claim 1 wherein;

at least one of said sensors is a motion sensor requiring an oscillator signal;

said control unit provides the oscillator signal; and said multi-conductor cable includes a pair of conductors for providing DC power to said intrusion sensors and said interface circuits, a conductor for providing said oscillator signal to said at least one motion sensor, and a conductor for conveying mode control signals from said control unit to said sensors and for conveying alarm signals from said sensors to said control unit.

5. The system of claim 1 wherein said interface circuit includes:

a latch circuit;

comparator means operative in response to said mode control signals to provide respective output signals to said latch circuit;

circuit means operative in response to an alarm signal above a predetermined reference level to provide an input signal to said latch circuit and to provide an alarm indication on said cable;

a driver circuit operative in response to output signals from said latch circuit for energizing a sensor indicator in accordance with the mode associated with the selected mode control signal.

6. For use in an intrusion detection system in which a plurality of intrusion sensors are coupled via a system cable to a central control unit, an interface module coupling each sensor to said cable and comprising:

first means operative in response to mode control signals on one line of said cable from said central control unit for providing selected control signals for energizing sensor indicators associated with the intrusion sensors in accordance with the selected mode;

said mode control signals being respective signal levels corresponding to selected display modes of the sensor indicators denoting present and past occurrence of alarm signals produced by the associated sensors; and means operative in response to intrusion detection by said sensors to provide an alarm signal on the same line of said cable for communication to said central control unit to cause an alarm indication at said central control unit irrespective of the selected display mode of the sensor indicators specified by the mode control signals.

7. The interface module of claim 6 wherein said first means includes first and second comparators, each having a respective reference source and operative in response to said mode control signals for providing outputs in accordance with the signal level of the mode control signals in relation to the reference signals;

latch means operative in response to the outputs from said first and second comparators for providing said selected control signals;

a bipolar detector operative in response to a differential intrusion detection signal to provide an output signal; and a third comparator operative in response to said output signal from said bipolar detector to provide an alarm signal to said latch means when said output signal differs from an applied reference signal for said third comparator by a predetermined amount.

8. The interface module of claim 6 wherein said mode control signals are at respective signal levels corresponding to a reset mode in which a sensor indicator denotes the presence of an associated alarm signal as it occurs, a latch mode in which a sensor indicator remains on after an associated alarm signal has ceased, and a freeze mode in which a sensor indicator remains in the state it was in at the time this freeze mode is initiated.

9. For use in an intrusion detection system in which a plurality of intrusion sensors are coupled via a system cable to a central control unit, an interface module coupling each sensor to said cable and comprising:

first means operative in response to mode control signals on one line of said cable from said central control unit for providing selected control signals for energizing sensor indicators associated with the intrusion sensors in accordance with the selected mode;

said mode control signals being at respective signal levels corresponding to selected display modes of the sensor indicators denoting present and past occurrence of alarm signals produced by the associated sensors; and means operative in response to intrusion detection by said sensors to provide an alarm signal on the same line of said cable for communication to said central control unit to cause an alarm indication at said central control unit irrespective of the selected display mode of the sensor indicators specified by the mode control signals;

said first means including comparator means operative in response to said mode control signals for providing outputs in accordance with the signal level of the mode control signals;

latch means operative in response to the outputs from said comparator means for providing said selected control signals;

a detector operative in response to an intrusion detection signal to provide an output signal; and second comparator means operative in response to said output signal from said detector to provide an alarm signal to said latch means and said means operative in response to intrusion detection when said output signal differs from a reference signal for said second comparator means by a predetermined amount.

* * * * *

UNITED STATES PATENT AND TRADEMARK OFFICE

CERTIFICATE OF CORRECTION

PATENT NO. : 4,321,592

DATED : March 23, 1982

INVENTOR(S) : Richard E. Crandall, Sheldon P. Apsell, and Aaron A. Galvin

It is certified that error appears in the above-identified patent and that said Letters Patent are hereby corrected as shown below:

Column 3, line 34, "circit package." should read --circuit package.--; and line 43, "now" should read --not--;

Column 4, line 38, "comparator 46" should read --comparator 56--; and line 43, "system alar, is" should read --system alarm, is--;

Column 6, line 39, "$V_{ce}$ of the Q13" should read --$V_{ce}$ of Q13--; and line 44, "network. if a" should read --network. If a--.

Signed and Sealed this

*Twenty-second* Day of *June 1982*

[SEAL]

*Attest:*

GERALD J. MOSSINGHOFF

*Attesting Officer*

*Commissioner of Patents and Trademarks*